United States Patent [19]

Tanaka et al.

[11] 4,096,838

[45] Jun. 27, 1978

[54] FUEL CONTROL SYSTEM FOR AN INTERNAL COMBUSTION ENGINE

[75] Inventors: Eizi Tanaka, Anjo; Michihiro Ohashi, Handa; Hiroshi Mochizuki; Akira Nishimatsu, both of Okazaki, all of Japan

[73] Assignee: Nippon Soken, Inc., Nishio, Japan

[21] Appl. No.: 752,305

[22] Filed: Dec. 20, 1976

[30] Foreign Application Priority Data

Dec. 26, 1975 Japan ..... 51-157416
Apr. 6, 1976 Japan ..... 51-38446

[51] Int. Cl.[2] ..... F02M 17/00; F02M 19/00

[52] U.S. Cl. ..... 123/139 AW; 123/140 MC; 123/139 BG; 123/119 R

[58] Field of Search ..... 123/139 AW, 139 BG, 123/140 MC, 119 R; 261/50 A, 52, 39 A

[56] References Cited

U.S. PATENT DOCUMENTS

| | | | |
|---|---|---|---|
| 3,739,762 | 6/1973 | Jackson | 123/139 BG |
| 4,002,153 | 1/1977 | Moriya et al. | 123/139 AW |
| 4,015,571 | 4/1977 | Stumpp | 123/139 BG |
| 4,022,175 | 5/1977 | Laprade et al. | 123/139 AW |

*Primary Examiner*—Charles J. Myhre
*Assistant Examiner*—R. A. Nelli
*Attorney, Agent, or Firm*—Cushman, Darby & Cushman

[57] ABSTRACT

In a fuel control system for an internal combustion engine comprising a sensing vane swingably disposed in an intake pipe of the engine and adapted to be angularly displaced in proportion to the flow rate of the intake air and a fuel control device in response to the angular displacement of said sensing vane for controlling the rate of fuel to be supplied to the engine in proportion to the flow rate of the intake air, a plurality of pressure-responsive actuators are operatively connected to said sensing vane and adapted to actuate in response to vacuum or air-pressure signals representative of the conditions of the engine such as acceleration and deceleration, the temperature of the engine and the ambient air pressure, respectively, to control the angular displacement of said sensing vane so as to change the ratio of the rate of fuel to be supplied to the engine to the flow rate of the intake air, whereby the air-fuel ratio is optimized according to engine conditions.

6 Claims, 6 Drawing Figures

FUEL CONTROL SYSTEM FOR AN INTERNAL COMBUSTION ENGINE

CROSS REFERENCE TO THE RELATED APPLICATIONS

The invention of this application has close connection to subject matters of the inventions of our copending applications Ser. Nos. 665,443 and 695,555, filed on Mar. 9, 1976 and on Apr. 5, 1976, respectively.

BACKGROUND OF THE INVENTION

The present invention relates generally to a fuel control system adapted for use in combination with a fuel injection system for continuously injecting fuel into an air intake pipe of a spark ignition internal combustion engine, for controlling the fuel supply in accordance with the flow rate of intake air and, more particularly, to a fuel control system capable of controlling the fuel supply and correcting the air-fuel ratio for varying engine conditions.

Conventionally, mechanical fuel control systems for internal combustion engine incorporates as shown, for example, in the specification of U.S. Pat. No. 3,728,993, a sensing vane or an air sensor sensitive to a change in the flow rate of intake air drawn into the engine, and adapted to slidingly move a fuel metering shaft or piston within a bearing thereby to control the area of a fuel controlling orifice, as well as a constant-pressure-differential valve for maintaning the pressure differential across the orifice constant, whereby the fuel supply is metered and controlled in accordance with the change in the intake air flow. The fuel supply is further controlled, in compliance with the varying engine requirement, by means of a hydraulic pressure adjusting mechanism having a spring which is effective, upon being adjusted, to vary the pressure exerted on the top surface of the aforementioned fuel metering piston. The adjustment of the spring is performed by axially and angularly displacing a three-dimensional cam in accordance with the magnitude of an intake vacuum and an opening degree of a throttle valve, which are varied in correspondence with the operating conditions of the engine.

Thus, these conventional fuel control systems are disadvantageously rendered complicated in structure and difficult to manufacture, by the presence of a three-dimensional cam having a cam contour which is highly complicated to enable the cam to work in response to the changes in both of the intake vacuum and the opening degree of the throttle valve over whole range of engine operation, and by the adoption of a complexed hydraulic control circuit under high pressure.

SUMMARY OF THE INVENTION

It is therefore an object of the invention to provide a fuel control system which is simplified in structure and capable of performing a highly accurate fuel control, without being assisted by the high pressure hydraulic circuit and the complicated cam contour which have been necessitated by conventional mechnical-hydraulic control systems.

It is another object of the invention to provide a fuel control system which normally allows a fuel supply to an engine in proportion to the flow rate of intake air, and capable of increasing and decreasing the fuel supply to the engine in accordance with the change in such conditions of the engine operation as cooling water temperature, ambient air pressure and/or accleration and deceleration of the engine, thereby to ensure a good operation of the engine and to reduce noxious exhaust emissions, especially those including CO and HC.

To these ends, according to the present invention, there is provided a simplified fuel control system wherein a first pressure-responsive mechanism adapted to be operated by a pneumatic signal controlled by a constant-pressure-differential valve is connected, by means of a linking mechanism, to a sensing vane sensitive to the flow rate of intake air, thereby to maintain a constant pressure differential across the sensing vane, and wherein the sensing vane is further connected, by another linking mechanism, to a second pressure-responsive mechanism adapted to be actuated by pneumatic signal delivered from a vacuum changeover valve, a temperature sensitive valve or an atmospheric pressure-deceleration-compensating valve.

The whole structure is rendered simple by adopting diaphragm-actuated valves and a thermo-wax valve for those valves controlling the second pressure-responsive mechanism, owing to their simple structures and readiness for manufacture and adjustment, and by employing a piping arrangement composed of such easily attachable piping elements as, for example, rubber hoses.

The invention will be more fully understood from the following description of preferred embodiments taken in conjunction with the attached drawings in which:

DESCRIPTION OF THE PREFERRED EMBODIMENTS

Figure 1:
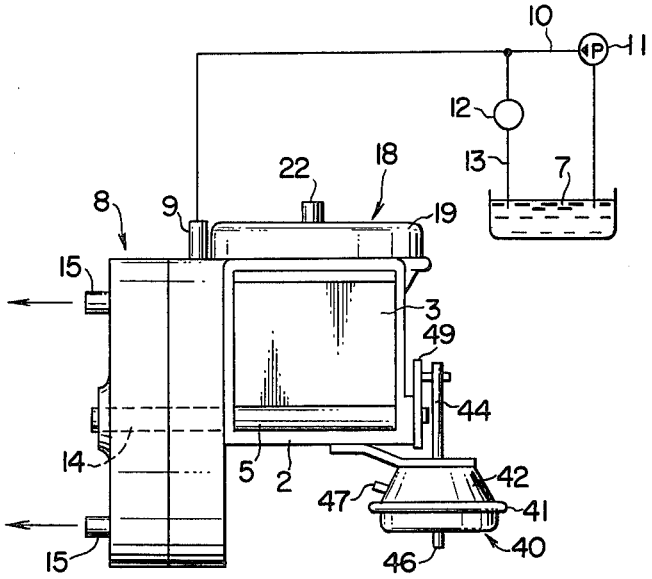
FIG. 1 schematically shows a fuel supply system for use in combination with a first embodiment of the invention.
Figure 2:
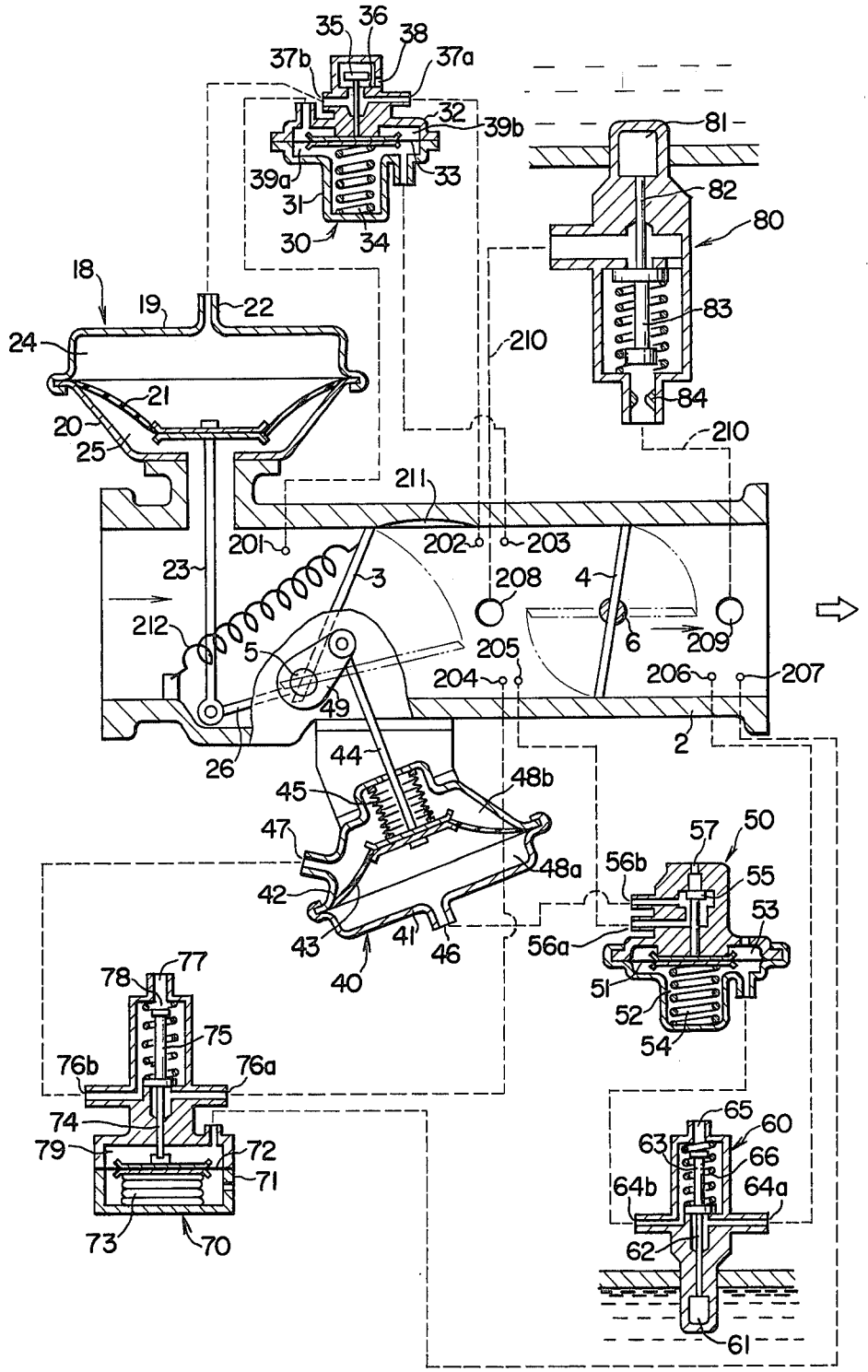
FIG. 2 is a schematic illustration of a control system which is the first embodiment of the invention.

Referring first to FIGS. 1 and 2 which show a first embodiment of the invention, a spark-ignited internal combustion engine has a rectangular-sectioned air intake pipe 2 in which disposed is an air-flow measuring member or a sensing vane 3 and a throttle valve 4 positioned downstream of the sensing vane 4, as viewed in the direction of the flow of the intake air represented by arrows. The sensing vane 3 and the throttle valve 4 are carried by a metering shaft 5 and a valve shaft 6, respectively, for smooth rotation unitarily therewith.

A fuel tank 7 is connected to an inlet port 9 of a fuel metering device 8, through a conduit 10 having a fuel pump 11 for pressurizing the fuel and a fuel pressure regulator 12 adapted to maintain a predetermined constant fuel pressure. A pipe 13 is provided for returning the excess fuel to the fuel tank 7. The fuel metering device 8 is adapted to play a double roles of fuel-metering and fuel-distribution, and is disposed at one side of the intake pipe 2. More specifically, the metering device 8 comprises a bearing 14 having a corresponding number of fuel metering slits 101 to the number of cylinders of the engine, and the metering shaft 5 rotatably received by the bearing 14 and having fuel control surfaces 102 at positions corresponding to the fuel metering slits 101 of the bearing 14, the fuel metering shaft 5 carrying the sensing vane 3 as aforementioned. Thus, the fuel metering device 8 distributes the fuel to the cylinders at a rate metered and controlled in accordance with the flow rate of intake air sensed by the sensing vane 3. The fuel metering device 8 further incorporates fuel differential pressure regulating valves 103 actuated by a metallic diaphragm 105 and adapted to maintain a constant pressure differential across each fuel orifice 104 defined by the metering slit 101 of the bearing 14 and the fuel control surface 102 of the metering shaft 5. The fuel introduced through the fuel inlet port 9 into the fuel metering device 8 is metered and distributed by the fuel orifices 104, and, thereafter forwarded to fuel injection nozzles (not shown) of respective cylinders through a corresponding number of fuel outlets 15 to the number of cylinders.

A first pressure-responsive mechanism 18 is mounted on the intake pipe 2, and is adapted for maintaining a constant pressure differential across the sensing vane 3 in response to a vacuum signal from the intake pipe 2. The first pressure-responsive mechanism 18 includes an upper and lower housings 19, 20, a rubber diaphragm 21 put between the housings, a vacuum inroducing port 22 formed in the upper housing 19 and a connecting rod 23 secured to the diaphragm 21 by means of a fixing metal piece. The diaphragm 21 and the housings 19, 20 cooperate to define a vacuum chamber 24 and another chamber 25 which are separated from each other by the diaphragm 21. The chamber 25 communicated with a space within the intake pipe 2 upstream of the sensing vane, i.e. with the atmosphere. An arm 26 is pivotally secured to the free end of the connecting rod 23. The arm 26 is connected at its other end to the sensing vane 3 thereby to constitute a link mechanism for inerlocking the diaphragm 21 and the sensing vane 3.

A constant-pressure-differential valve 30 is provided for controlling a vacuum or air pressure signal applied to the vacuum chamber 24 of the first pressure-responsive mechanism 18, and includes housings 31, 32, a diaphragm 33 clamped by the housings 31, 32, a spring 34 for biasing the diaphragm 33, a valve 35 connected to the diaphragm 34 by a shaft and a fixing metal, a valve seat 36 adapted to cooperate with the valve 35 in defining an orifice, a vacuum inlet port **37*a*, a vacuum outlet port 37*b* and a port 38 communicating with ambient atmosphere. A chamber 39*a* defined by the housing 31 and the diaphragm 33 is connected through a rubber hose to a port 203 which opens to the intake pipe 2 at a position between the sensing vane 3 and the throttle valve 4. Another chamber 39*b* separated from the first mentioned chamber 39*a* by the diaphragm 33 is connected to a port 201 which opens to the intake pipe 2 at a position upstream of the sensing vane 3. Thus, the pressure differential across the sensing vane 3 is introduced to the chambers 39*a* and 39*b*, so as to actuate the valve 35 in response to the pressure differential, thereby to control the vacuum or air pressure output signal from the vacuum outlet port 37*b***.

A second pressure-responsive mechanism 40 is provided for controlling the rotation of the metering shaft 5, i.e. the motion of the sensing vane 3, in response to a vacuum or air pressure signal, and is composed of housings 41, 42, a diaphragm 43 interposed between the housings 41, 42, a connecting rod 44 secured to the diaphragm 43 by a fixing metal piece, a sealing bellows 45 surrounding the connecting rod 44, and vacuum inlet ports 46, 47 formed in respective housings 41, 42. The housing 41 defines a vacuum chamber **48*a* in cooperation with the diaphragm 43, while the housing 42 defines another vacuum chamber 48*b* in cooperation with the diaphragm 43 and the bellows 45. The connecting rod 44 is connected at its free end to a link plate 49 which is fixed to the metering shaft 5 at the exterior of the intake pipe 2, so as to provide an interlocked relation between the diaphragm 43 and the metering shaft 5. The first and the second pressure-responsive mechanisms 18 and 40 are fixed to the intake pipe 2** by suitable known fixing means respectively.

A vacuum change-over valve 50 is provided to control the vacuum signal applied to the vacuum chamber **48*a* of the second pressure-responsive mechanism 40, and consists of a known diaphragm-actuated three-way valve. The vacuum change-over valve 50 has a valve head 55 adapted to be actuated by the pressure differential applied to a diaphragm 51, i.e. the pressure differential between a vacuum chamber 52 and an atmospheric pressure chamber 53 which are separated from each other by the diaphragm 51, and by the force exerted by a spring 54. The arrangement is such that a vacuum outlet 56*b* communicating with the vacuum inlet port 46 of the second pressure-responsive mechanism 40 is normally communicated with a vacuum inlet port 56*a* which in turn communicates with a port 205 opening to the intake pipe 2 at a position between the sensing vane 3, and the throttle valve 4, while the vacuum outlet port 56*b* is allowed to communicate with an atmospheric port 57 when a vacuum signal introduced to the vacuum chamber 52** exceeds a predetermined level.

A temperature sensitive valve 60 which consists of a known thermo-wax change-over valve is further provided to control the vacuum signal applied to the vacuum chamber 52 of the vacuum change-over valve 50 in response to the temperature of the engine, e.g. the temperature of cooling water or of lubrication oil. To explain in more detail, the temperature sensitive valve 60 has a thermo-wax unit 61 housing a thermo-wax the volume of which changes in accordance with the change in ambient temperature. The thermo-wax unit 61 is disposed suitably to detect the temperature of the cooling water or the lubrication oil and is adapted to slide a rod 62 thereby to actuate a valve body 63 which has valve heads at its respective ends. The arrangement is such that, when the detected temperature exceeds a predetermined temperature, a vacuum inlet port **64*a* which communicates with a port 206 opening to the intake pipe 2 downstream of the throttle valve 4 is communicated with a vacuum outlet port 64*b* which communicates with the vacuum chamber 52 of the vacuum change-over valve 50, while, when the detected temperature is lower than the predetermined temperature, a spring 66 acts to allow the vacuum outlet port 64*b* to communicate with an atmospheric port 65**. Obviously, the thermo-wax may be substituted by another temperature-sensitive means such as a bimetal.

An atmospheric-pressure-deceleration-compensation valve 70 is for controlling the vacuum signal applied to the vacuum chamber **48*b* of the second pressure-responsive mechanism 40, in response to the change in atmospheric pressure. The valve 70 at the same time plays an additional role of controlling the same vacuum signal when the engine is decelerated. The atmospheric-pressure-deceleration-compensation valve 70 is composed of a housing 71, a diaphragm 72, a vacuum bellows 73 disposed between the diaphragm 72 and the housing 71, a rod 74 and a valve body 75 adapted to be moved by the rod 74 which, in turn, is moved by the expansion or shrinkage of the vacuum bellows 73. Assuming that the ambient air pressure around the engine is lower than a predetermined pressure, a vacuum inlet port 76***a* which communicates with a port 204 opening to the intake pipe 2 upstream of the throttle valve 4 is allowed to communicate with a vacuum outlet port 76*b* which communicates with the vacuum inlet port 47 of the second pressure-sensitive mechanism 40, while, when the atmospheric pressure is higher than a predetermined pressure, the vacuum outlet port 76*b* comes to be communicated with an atmospheric port 77 by a spring 78. The diaphragm 72 and the housing 71 defines a vacuum chamber 79 at one side of the diaphragm 72 opposite to the vacuum bellows 73. The vacuum chamber 79 communicates with a port 207 formed in the intake pipe 2 downstream of the throttle valve 4.

A second temperature-sensitive valve 80 for an additional control is adapted to open and close by a bypass passage 210 in response to the temperature of the engine. The bypass passage 210 interconnects ports 208 and 209 which open to the air intake pipe 2 upstream and downstream of the throttle valve 4, respectively, thus bypassing the throttle valve 4. The second temperature-sensitive valve 80 may consists of a thermo-wax actuated valve similar to that of the first temperature sensitive valve 60, having a thermo-wax unit 81 disposed suitably for detecting the temperature of the cooling water or of the lubricating oil. The thermo-wax unit 81 is effective to slidingly move a rod 82 thereby to actuate a valve body 83. When the detected temperature is lower than a predetermined temperature, the bypass passsage 210 is opened, while, when the detected temperature is higher than the predetermined temperature, the valve body 83 closes the bypass passage 210. The bypass passage is provided with an orifice 84 for restricting the flow therethrough when it is opened.

The intake pipe 2 is formed on its inner wall downstream of the sensing vane 3 with an area-compensation recess 211 which is so shaped and dimensioned as to make the cross-sectional area for air in linear proportion to the opening degree of the sensing vane 3. The sensing vane 3 is biased in the direction to close the passage, by means of a spring 212. Since the signals are born by vacuum or air pressure, the connections between the valves and the pressure-responsive mechanisms are conveniently provided by easily attachable conduit means such as rubber hoses, without necessitating such strict and high pressure pipings as are required in the conventional control system employing fuel as the working medium thereof.

In operation, during the working of the engine, the intake air flows in the direction of an arrow as the throttle valve 4 is opened. The sensing vane 3 is rotated by the air flow against the biasing force of the returning spring 212, along with the metering shaft 5. The rotation of the sensing vane 3 is caused by the pressure of the air flow and by the force differential exerted by the first and the second pressure-responsive mechanisms 18 and 40.

In the fuel metering device 8, as the metering shaft 5 rotates, the metering surfaces on the metering shaft 5 and the metering slits in the bearing 14 define fuel orifices the areas of which correspond to the flow rate of the intake air. The fuel is supplied from the fuel tank 7 by the fuel pump 11 at an almost constant pressure regulated by the regulator 12, to the inlet 9 of the fuel metering device 8, through the conduit 10. The fuel is then passes through the fuel metering orifices and is forwarded from the outlets 15 to the injection nozzles (not shown) which are corresponding in number to the number of the cylinders, to be continuously injected therefrom at a relatively low pressure to an intake manifold (not shown).

Supposing that the engine is operating with a relatively light load and that the influence of the atmospheric pressure is negligibly low, i.e. that there is no need for compensating the influence of the atmospheric pressure, the rotation of the sensing vane 3 is ruled by the pressure of the intake air opposing to the force of the spring 212, and by the first pressure-responsive mechanism 18.

Namely, the vacuum at a position between the throttle valve 4 and the sensing vane 3 is transmitted from the port 202 to the vacuum chamber 24 of the first pressure-responsive mechanism 18, through the constant pressure-differential valve 30, and the sensing vane 3 is balanced when the pressure differential across the sensing vane 3 reaches a predetermined one.

The pressure differential across the sensing vane 3 is transmitted to the chambers 39*a*, 39*b* of the constant-pressure differential valve 30 and deflects the diaphragm 33 assisted by the spring 34, thereby to form an orifice of a certain cross-sectional area between the valve 35 and the seat 36, so as to allow the introduction of air through the atmospheric port 38. Consequently, the vacuum transmitted from the port 202 is weakened before it is transmitted to the vacuum chamber 24 of the first pressure-responsive mechanism 18. Supposing here that the flow rate of the intake air is changed so that the pressure differential across the sensing vane 3 deviates from the predetermined one. This change is transmitted to the constant-pressure-differential valve 30 from the ports 201 and 202 and causes the cross-sectional area of its orifice to change. Consequently, the vacuum applied to the vacuum chamber 24 is varied to change the force acting on the diaphragm thereby to change the opening degree of the sensing vane 3, so as to maintain the constant pressure differential across the sensing vane 3.

Since the cross-sectional area of air passage defined by the sensing vane 3 and the wall of the intake pipe 2 is maintained in proportion to the opening degree of the sensing vane 3 by the presence of the compensation recess 211, and since the pressure differential across the sensing vane 3 is maintained constant by the constant-pressure differential valve 30, the flow rate of the intake air is ensured to be in proportion to the opening degree of the sensing vane 3, i.e. to the angular displacement of the metering shaft 5. Thus, the rate of fuel supply through the fuel orifice of the fuel metering device 8 is controlled substantially in proportion to the flow rate of the intake air.

Concerning the air-fuel ratio, it is not always a good policy to provide a mixture of a constant air-fuel ratio, from the view points of good operation of the engine and of cleaning the exhaust emissions. Thus, it is preferable to make the mixture richer or leaner, in accordance with the conditions of the engine, by varying the rate of the fuel supply. This function is performed in the present invention as will be described hereinunder.

Assuming that the engine is still cold, as is the case of soon after the cold start, the thermo-wax in the thermo-wax unit 61 of the temperature sensitive valve 60 contracts due to low temperature of the cooling water (or the lubricating oil). The spring 66 is then effective to move the valve body 63 so as to allow the latter 63 to close the vacuum inlet port 64*a* and to open the atmospheric port 65. Accordingly, the vacuum supply from the port 206 is substituted by an air supply through the atmospheric port 65 to the vacuum chamber 52 of the vacuum change-over valve 50. Consequently, in the vacuum change-over valve 50, the spring 54 is allowed to move the valve head 55 to close the atmospheric port 57 and insteadly to open the vacuum port 56 so as to allow a vacuum from the port 205 to reach the vacuum chamber 48*a* of the second pressure-responsive mechanism 40, so as to actuate the sensing vane 3 for a larger opening degree, by the link plate 49. Thus, the rate of fuel supplied is increased corresponding to the angular displacement of the sensing vane 3, i.e. the metering shaft 5, while the flow rate of intake air is kept unchanged.

Referring now to the temperature sensitive valve 80, the valve 80 keeps the bypass passage 210 opened due to the low temperature of the engine, so as to allow an air flow bypassing the throttle valve 4, from the port 208 to the port 209, through the orifice 84. Thus, during the warming up of the engine, the engine is operated at a speed higher than normal idling speed with a richer fuel-air mixture containing a larger amount of air and a larger amount of fuel. This is enough to stabilize the running of the engine during the warming up.

As the temperature of the engine gets higher, the thermo-wax 81 gradually expands due to the elevated temperature of the cooling water or the lubrication oil, thereby to move the valve body 83 through the rod 82 to close the bypass passage and to stop the by-passing air flow. Then only the air having passed the throttle valve 4 is allowed to get into the engine, which air is enough to maintain the normal idle running of the engine. Turning again to the temperature sensitive valve 60, the thermo-wax in the thermo-wax unit 61 expands to move the valve body 63 to close the atmospheric port 65 and to open the passage communicating with the vacuum inlet port 64*a*. Consequently, the vacuum from the port 206 is allowed to reach the vacuum chamber 52 of the vacuum change-over valve 50. The vacuum then moves the valve head 55 against the force of the spring 54, so that the vacuum supply from the port 205 to the vacuum chamber 48*a* of the second pressure-responsive mechanism 40 is substituted by an air supply from the atmospheric port 57. Then, the second pressure-responsive mechanism 40 becomes inactive to the sensing 3, thus cutting the additional fuel supply.

In case that the throttle valve 4 is largely opened, as is the case of heavy load operation and/or acceleration of the engine, the intake vacuum gets correspondingly low. When the intake vacuum is lowered to, for example, −80 mmHg, the vacuum acting on the diaphragm 51 of the vacuum change-over valve 50 becomes correspondingly low, so as to allow the spring 54 to displace the valve head 55. Consequently, the vacuum from the port 205 is applied to the vacuum chamber 48*a* of the second pressure-responsive mechanism 40 which then actuates the sensing vane 3 for a larger opening degree thereby to perform an increase of the fuel supply required for the heavy load operation or for the acceleration of the engine.

When the engine is used at heights, the vacuum bellows 73 housed in the atmospheric chamber of the atmospheric-pressure-deceleration-compensating valve 70 expands corresponding to the falling down of ambient pressure, so as to move the valve body 73 to open the passage for the vacuum inlet port 76*a* and to close the atmospheric port 77. Consequently, a communication is established between the ports 76*a* and 76*b*, so that a vacuum from the port 204 is allowed to reach the vacuum chamber 48*b* of the second pressure-responsive mechanism 40. Accordingly, the second pressure-responsive mechanism 40 acts to move the sensing vane 3 for a smaller opening degree thereby to decrease the fuel supply corresponding to the thinning of the ambient air which in turn is corresponding to altitude. This is effective to restrain the emissions of CO and HC which would for otherwise be caused by an unduly rich fuel-air mixture.

During the deceleration of the engine, the throttle valve 4 is abruptly closed to cause a high vacuum (−400 mmHg, for example) downstream of the throttle valve 4. Therefore, in the atmospheric-pressure-deceleration-compensating valve 70, a high vacuum is transmitted to the vacuum chamber 79 from the port 207, which deflects the diaphragm 72 irrespective of actuation of the bellows 73. As a result, the valve member 75 is moved to close the atmospheric port 77 and to open the passage for the vacuum inlet port 76*a*, thereby to allow the vacuum transmitted from the port 204 to reach the vacuum chamber 48*b*. Consequently, the sensing vane 3 is rotated for a smaller opening degree similarly to the case of the operation at heights. Thus, the fuel supply is decreased corresponding to the decrease of the opening degree of the sensing vane 3 thereby to provide a mixture which is lean enough to prevent a misfiring which is likely to occur due to the short air during the deceleration, as well as to reduce the HC and CO emissions, and to ensure an economic use of fuel.

As the deceleration is over, the atmospheric-pressure-deceleration compensation valve 70 is returned to its initial condition, so as to allow the vacuum chamber 48*b* to communicate with ambient air, thereby to provide the previously set air-fuel ratio of the mixture.

Figure 3:
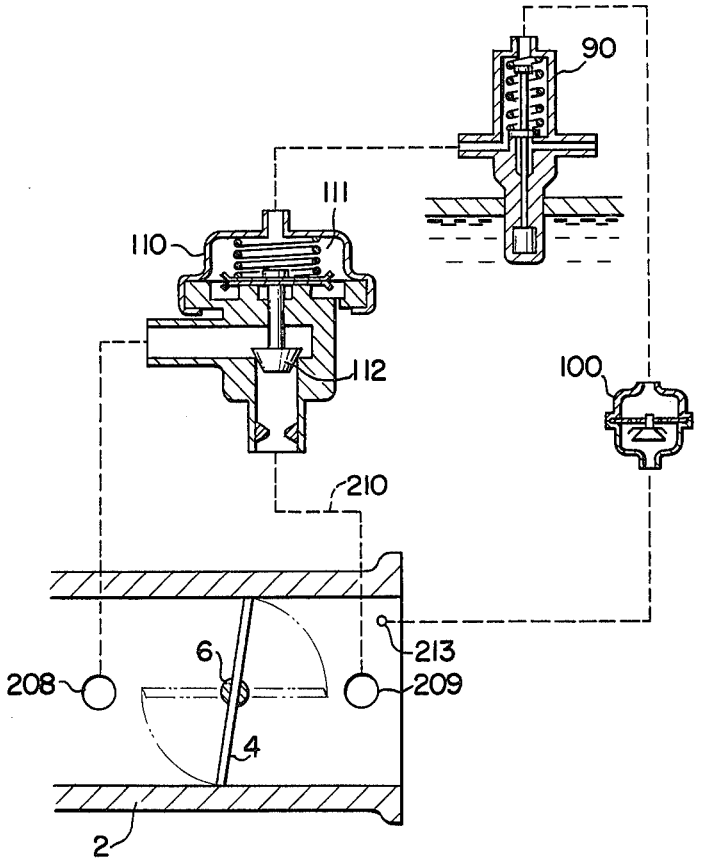
FIG. 3 is a schematic illustration of an essential part of a second embodiment of the present invention.
Figure 1A:
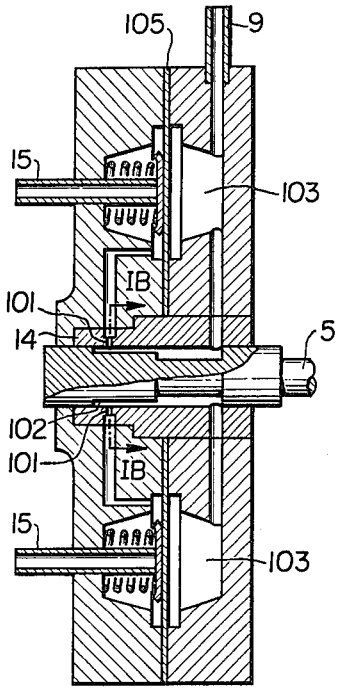
FIG. 1A is a sectional side view showing a detailed structure of the fuel monitoring device shown in FIG. 1.
Figure 1B:
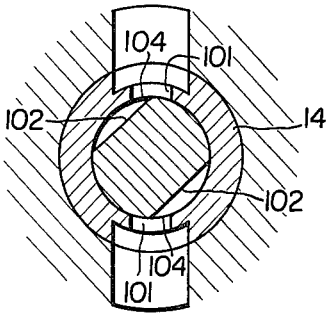
FIG. 1B is an enlarged sectional view taken along lines 1B—1B of FIG. 1A

In the foregoing description, the bypass passage is directly controlled by the temperature sensitive valve 80. Alternatively, in a second embodiment of the invention as shown in FIG. 3, another temperature valve 90 having a construction similar to that of the temperature sensing valve 80 is used to control a vacuum which is transmitted through a check valve 100 from a port 213 opening downstream of the throttle valve. The controlled vacuum is then transmitted to a known diaphragm-actuated valve 110 provided in the bypass passage 210 thereby to open and close the latter 210. Thus, when the temperature of the engine is low, the vacuum is applied to a vacuum chamber 111 of the valve 110 so as to open the valve 112, while, as the temperature gets higher, the valve 112 is closed due to an atmospheric pressure applied to the vacuum chamber 111. This arrangement is superior in that it allows to install the temperature sensitive valve 90 away from the bypass passage 210.

In the foregoing first embodiment, the ambient air, pressure and the temperature of the engine are taken into account, in addition to the acceleration and deceleration of the engine, in controlling the fuel supply. However, if desired, these additional conditions can be neglected.

Figure 4:
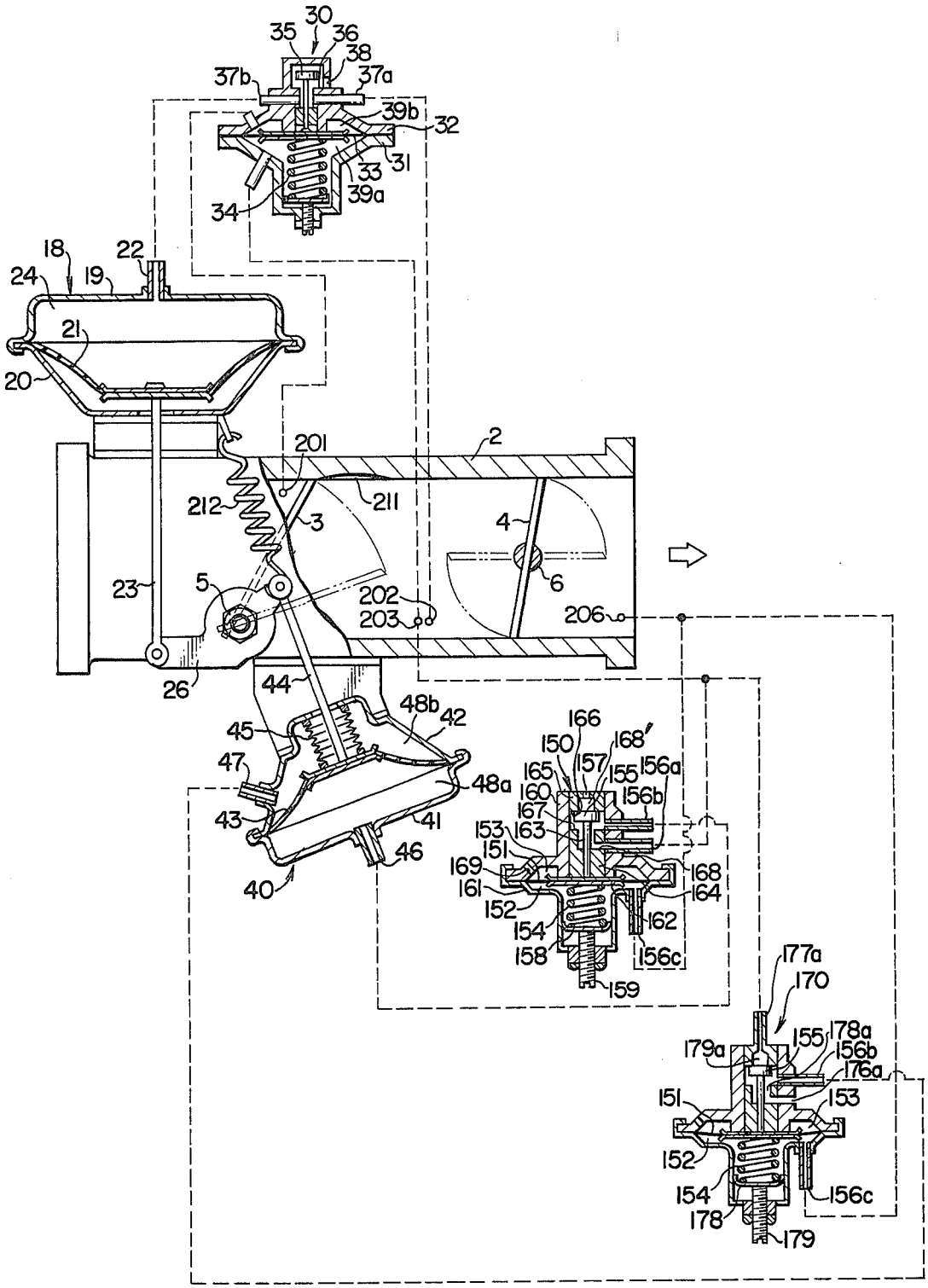
FIG. 4 is a schematic illustration of a control system which constitutes a third embodiment of the present invention.

Namely, in the third embodiment of the invention as shown in FIG. 4, two vacuum change-over valves 150 and 170 are employed for compensating the fuel supply only for the acceleration and deceleration of the engine. The vacuum change-over valves 150 and 170 are similar in construction to that of the vacuum change-over valve 50 of FIG. 2, excepting that they have spring retainers 158 and 178 and bolts 159 and 179 for adjusting the load of the springs. To explain in more detail, the vacuum change-over valve 150 for acceleration consists of housings 160, 161, a diaphragm 151, a plate 162 for retaining the diaphragm 151, a slidable shaft 163 fixed to the diaphragm 151, a valve head 155 fixed to the end of the shaft, a bearing 164 for the slidable shaft 163, a stopper member 165 for the valve head 155, flat valve seats 166, 167 formed on the stopper member 165 and on the bearing 164, respectively, a return spring 154, load adjusting means for the spring 154 consisting of a spring retainer 158 and a bolt 159, vacuum inlet ports **156*a*, 156*c*, a vacuum outlet port 156*b*, a vacuum passage 168 for communication between the vacuum inlet port 156*a* and the vacuum outlet port 156*b*, and an atmospheric port 157 formed in the stopper member 165. The diaphragm 151 defines in cooperation with the housings 160, 161, an atmospheric chamber 153 and a vacuum chamber 152. The atmospheric chamber 153 communicates with atmosphere through a first atmosphere introducing port 169, while the vacuum chamber 152 communicates with a port 206 provided downstream of the throttle valve 4, through one 156*c* of the vacuum inlet ports. The other vacuum inlet port 156*a* is communicated with a port 203 formed in the intake pipe 2, while the vacuum outlet port 156*b* is in communication with the vacuum inlet port 46 of the second pressure-responsive mechanism 40**.

The vacuum change-over valve 170 for deceleration has a construction similar to that of the valve 150 for the acceleration. Thus, the same portions are designated at the same numerals, excepting that, in the vacuum change-over valve 170, an atmospheric pressure introducing port **176*a* and a vacuum inlet port 177*a* are substituted for the vacuum inlet port 156*a* and the atmospheric port 157 of the vacuum change-over valve 150, respectively. Thus, the vacuum passage 168 and the air passage 168' in the vacuum change-over valve 150 are substituted by an air passage 178*a* and a vacuum passage 179*a*, respectively, in the second vacuum change-over valve 170** designed for the deceleration.

In the second change-over valve 170, the vacuum inlet port **177*a* is in communication with the port 203, while the vacuum outlet port 156*b* is connected to the vacuum inlet port 47 of the second pressure-responsive valve 40**.

In operation, when the engine is normally operated with an intake vacuum of, for example, between −80 mmHg and −400 mmHg, the change-over valves 150 and 170 are both opened to the atmosphere, so that the second pressure-responsive mechanism 40 is kept inactive for the sensing vane 3. Therefore, the first pressure-responsive mechanism 18 solely is effective to preserve the predetermined pressure differential across the sensing vane 3, ensuring the predetermined air-fuel ratio of the mixture. During a high-load operation or an acceleration of the engine, as the vacuum lowers down close to the atmospheric pressure, say to smaller than −80 mmHg, the vacuum change-over valve 150 is switched to allow the vacuum to reach the vacuum chamber **48*a*. Consequently, the second pressure-responsive mechanism 40 acts to rotate the sensing vane 3 along with the metering shaft 5, for a larger opening degree of the sensing vane 3. The sensing vane 3 is then balanced at a position, under the influence of the constant-pressure-differential valve 30, where the resulted pressure differential across the sensing vane 3 is smaller than the previously set one. Thus, the sensing vane 3** is kept at the position to provide a larger amount of fuel supply.

When the engine is being decelerated, as the intake vacuum gets higher than −400 mmHg for instance, the vacuum change-over valve 170 is switched to allow the vacuum to reach the vacuum chamber **48*b*, so that the sensing vane 3 is rotated for a smaller opening degree, thereby to decrease the rate of fuel supply. Namely, in this condition, the sensing vane 3 is balanced at a position where the resulted pressure differential is larger than the previously set one, so as to decrease the fuel supply, whereas the flow rate of the intake air is kept unchanged. This is effective to prevent a misfiring which is likely to be caused by an excessive fuel supply and short of air, during the deceleration, as well as to reduce the emissions of HC and CO, and contribute to the economical use of the fuel. As the deceleration is over, the vacuum chamber 48*b* of the second pressure-responsive mechanism 40 again comes to be communicated with the atmosphere, so as to return the sensing vane 3 to its initial position. Consequently, the pressure differential across the sensing vane 3 and, accordingly, the air-fuel ratio are returned to the pre-adjusted ones. It is to be noted that the vacuum chamber 48*a* and 48*b* of the second pressure-responsive mechanism 40 can never be maintained at atmospheric pressure concurrently. This is because there exists a large differential between the pressures for actuating the first and the second vacuum change-over valves 150, 170. For example, the change-over valve 150 is operative at an intake vacuum of −80 mmHg or smaller, while the vacuum change-over valve 170** becomes operative when the intake vacuum is −400 mmHg or higher.

Although preferred embodiments have been described with specific terms, it is to be noted that various changes and modifications may be imparted thereto, without departing from the scope of the invention which is limited solely by the appended claims.

What is claimed is:

1. A fuel control system for a spark ignition internal combustion engine having an intake pipe, comprising:

a throttle valve disposed within said intake pipe for controlling the flow of intake air;

an air-flow measuring member mounted for an angular movement within said intake pipe at a position upstream of said throttle valve, the amount of said angular movement of said air-flow measuring member being substantially in proportion to the flow rate of said intake air;

fuel measuring means operatively connected to said air-flow measuring member and adapted to meter and control the rate of fuel supply to said engine in accordance with said angular movement of said airflow measuring member, said fuel metering means having a fuel metering shaft unitarily connected to said air-flow measuring member for angular movement therewith and a bearing for rotatably supporting said fuel metering shaft, said fuel metering shaft and said bearing in combination defining at least one variable fuel metering orifice therebetween;

a first pressure-response means connected to said fuel metering shaft so as to drive the metering shaft and adapted to control said angular movement of said fuel metering shaft in response to pneumatic signals;

a second pressure-responsive means connected to said fuel metering shaft so as to drive the metering shaft and adapted to control said angular movement of said fuel metering shaft in response to pneumatic signals;

a constant-pressure-differential valve adapted to control a pneumatic signal to be applied to said first pressure-responsive means in response to a pressure differential across said air-flow measuring member, thereby to keep said pressure differential at a predetermined value; and detecting means mounted on said engine for detecting conditions of operation of said engine, and adapted to produce pneumatic signals representative of said conditions, said detecting means being pneumatically connected to said second pressure-responsive means so as to deliver said signals to said second pressure-responsive means;

whereby fuel-air mixtures of an air-fuel ratio corresponding to said conditions are supplied to said engine.

2. A fuel control system as claimed in claim 1 wherein said constant-pressure-differential valve comprises:

a housing;

a diaphragm disposed within said housing and defining a first chamber in communication with said intake pipe at a position upstream of said air-flow measuring member and a second chamber in communication with said intake pipe at a position downstream of said air-flow measuring member;

a vacuum chamber provided with a vacuum inlet port in communication with a vacuum source in said engine, a vacuum outlet port through which the vacuum in said vacuum chamber is transmitted to said first pressure-responsive means, and a port in communication with ambient atmosphere;

a valve head fixed to said diaphragm for displacement therewith so as to control the air flow through said port communicating with the atmosphere; and spring means disposed in said second chamber for biasing said diaphragm toward said first chamber.

3. A fuel control system for a spark ignition internal combustion engine having an intake pipe and a sensing vane disposed in said intake pipe in series to a throttle valve for measuring the flow rate of the intake air, the fuel supply to said engine being controlled in accordance with the opening degree of said sensing vane, comprising:

a first and a second pressure-responsive means operatively connected to said sensing vane and adapted to control the opening degree of said sensing vane upon receipt of pneumatic signals, respectively;

a constant-pressure-differential valve adapted to control the pneumatic signal to be applied to said first pressure-responsive means in response to a pressure differential across said sensing vane thereby to maintain said pressure differential at a predetermined value;

a change-over valve for acceleration adapted to provide said second pressure-responsive means with a pneumatic signal to actuate said sensing vane for a larger opening degree of said sensing vane during an acceleration of said engine; and another change-over valve for deceleration adapted to provide said second pressure-responsive means with another pneumatic signal to actuate said sensing vane for a smaller opening degree of said sensing vane during an deceleration of said engine.

4. A fuel control system for a spark ignition internal combustion engine having an intake pipe and a sensing vane disposed in said intake pipe in series to a throttle valve for measuring the flow rate of the intake air, the rate of fuel supply being controlled in accordance with the opening degree of said sensing vane, comprising;

a first and a second pressure-responsive means operatively connected to said sensing vane and adapted to control the opening degree of said sensing vane upon receipt of pneumatic signals, respectively;

a constant-pressure-differential valve adapted to control the pneumatic signal to be applied to said first pressure-responsive means in response to a pressure differential across said sensing vane thereby to maintain said pressure differential at a predetermined value;

a change-over valve pneumatically connected to said intake pipe and adapted to produce a signal to be applied to said second pressure-responsive means to increase the opening degree of said sensing vane when intake vacuum in said intake pipe is smaller than a predetermined vacuum; and another change-over valve pneumatically connected to said intake pipe and adapted to produce a signal, when the intake vacuum in said intake pipe is higher than a predetermined vacuum, to be applied to said second pressure-responsive means to decrease the opening degree of said sensing vane;

whereby the rate of fuel supply to said engine is increased or decreased in accordance with the change in said intake vacuum.

5. A fuel control system for a spark ignition internal combustion engine having an intake pipe and a sensing vane disposed in said intake pipe in series to a throttle valve, said sensing vane being adapted to measure a flow rate of intake air in said intake pipe, the fuel supply to said engine being controlled in accordance with the opening degree of said sensing vane, comprising:

a first and a second pressure-responsive means operatively connected to said sensing vane and adapted to control the opening degree of said sensing vane upon receipt of vacuum signals, respectively;

a constant-pressure-differential valve adapted to control said vacuum signal to be applied to said first pressure-responsive means in response to a pressure differential across said sensing vane thereby to maintain said pressure differential at a previously adjusted value;

a vacuum change-over valve adapted to control a vacuum signal to be applied to said second pressure-responsive means in response to an intake vacuum signal in said intake pipe, said vacuum signal to be applied to said second pressure-responsive means being for increasing the opening degree of said sensing vane;

a temperature sensitive valve adapted to control said intake vacuum signal to be applied to said change-over valve in response to the temperature of said engine; and an atmospheric-pressure-deceleration-compensation valve adapted to control a vacuum signal for decreasing said opening degree of said sensing vane to be applied to said second pressure-responsive means in response to a change in ambient atmospheric pressure;

whereby the rate of fuel supply to said engine is increased and decreased in accordance with the change in said intake vacuum, while said rate of fuel supply is increased and decreased, respectively, when the temperature of said engine is lower than a predetermined temperature and when said ambient atmospheric pressure is lower than a predetermined pressure.

6. A fuel control system as claimed in claim 5, further comprising a bypass passage bypassing said throttle valve for supplying an additional air, and an additional-air control valve provided in said bypass passage for controlling the area of passage for said additional air, said additiona-air control control valve having a temperature sensitive element adapted to open and close a valve body in response to a temperature and disposed suitably for detecting the temperature of said engine, whereby said additional air is supplied to said engine during warming up of said engine.

* * * * *